US011877648B2

(12) United States Patent
Kondel

(10) Patent No.: US 11,877,648 B2
(45) **Date of Patent: *Jan. 23, 2024**

(54) MOBILE TABLE WITH SELECTIVELY ROTATING TABLE TOP

(71) Applicant: Roots Engineering Services, Venice, FL (US)

(72) Inventor: Jeffrey M Kondel, Venice, FL (US)

(73) Assignee: Roots Engineering Services, Venice, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/626,631

(22) PCT Filed: Jul. 22, 2020

(86) PCT No.: PCT/US2020/042957

§ 371 (c)(1),
(2) Date: Jan. 12, 2022

(87) PCT Pub. No.: WO2021/016287

PCT Pub. Date: Jan. 28, 2021

(65) Prior Publication Data

US 2022/0257005 A1 Aug. 18, 2022

Related U.S. Application Data

(60) Provisional application No. 62/876,918, filed on Jul. 22, 2019.

(51) Int. Cl.
*A47B 13/08* (2006.01)

(52) U.S. Cl.
CPC ..... *A47B 13/081* (2013.01)

(58) Field of Classification Search
CPC ..... A47B 13/081; A47B 19/06; A47B 27/02; A47B 2200/0043

(Continued)

(56) References Cited

U.S. PATENT DOCUMENTS 623,786 A * 4/1899 Humphrey ..... B23D 45/107 83/559
822,701 A * 6/1906 Sutton ..... A47B 23/046 108/6

(Continued)

FOREIGN PATENT DOCUMENTS

FR 2290922 A1 * 6/1976
FR 2290922 A1 7/1976

OTHER PUBLICATIONS

International Search Report (ISR) for PCT/US2020/042957 dated Oct. 30, 2020 (3 pages).

(Continued)

*Primary Examiner* — Jose V Chen
(74) *Attorney, Agent, or Firm* — Shumaker, Loop & Kendrick, LLP

(57) ABSTRACT

Disclosed are mobile tables and table assemblies having a selectively rotating table top relative to the table frame. A mobile table including a selectively rotatable table top that is configured to securely rotate about an axis in an unlocked position and to be secured in a predetermined plane in a locked position; and two spaced apart frame members securely connected to the selectively rotatable table top positioned on a first end of each spaced apart frame member and movement members attached to a second end of each spaced apart frame members that are configured to selectively move the mobile table to and from desired locations.

20 Claims, 11 Drawing Sheets

(58) Field of Classification Search
USPC ..... 108/1, 8; 297/423.1, 423.39, 423.41, 297/423.44
See application file for complete search history.

(56) References Cited

U.S. PATENT DOCUMENTS 1,079,487 A * 11/1913 Hasenzahl ..... A47B 23/046 248/185.1
1,691,191 A * 11/1928 Henderson ..... A47B 19/06 108/8
1,708,761 A * 4/1929 Horbath ..... E21D 11/03 248/404
2,579,348 A * 12/1951 Taylor ..... F16M 11/08 108/4
2,600,759 A * 6/1952 Gross ..... A47C 17/34 297/118
2,775,497 A * 12/1956 Alvarez ..... A47B 27/02 108/2
2,850,081 A * 9/1958 Dillon ..... A47C 16/025 248/397
2,912,046 A * 11/1959 Fuerst ..... A47C 16/025 248/397
2,932,038 A * 4/1960 Sprague ..... A61H 1/0218 601/24
3,119,356 A * 1/1964 Sauer ..... A47C 16/025 248/397
3,152,802 A * 10/1964 Heisler ..... A61H 1/0218 5/624
3,653,339 A * 4/1972 Hester, Sr. ..... A47B 9/08 108/1
3,667,803 A * 6/1972 Ford ..... A47B 85/00 297/283.1
4,762,362 A * 8/1988 Brunn ..... A47C 4/16 297/26
5,294,180 A * 3/1994 Grimm ..... A47C 16/025 297/423.46
5,577,806 A * 11/1996 Ugalde ..... A47C 16/025 248/397
5,613,922 A * 3/1997 Hsiang ..... A63B 69/0097 482/28
5,626,393 A * 5/1997 Levasseur ..... A47C 16/025 108/1
6,113,182 A * 9/2000 Wise ..... A47B 85/06 297/119
6,435,305 B1 * 8/2002 Ward ..... A47C 3/04 182/178.1
6,846,043 B1 * 1/2005 Leoutsakos ..... A47C 16/025 297/423.46
7,588,292 B2 * 9/2009 Valdes ..... A47C 9/10 297/423.46
7,594,475 B1 * 9/2009 Huang ..... A47B 9/16 297/423.46
7,708,348 B2 * 5/2010 Barr ..... A47C 16/025 297/423.46
8,291,830 B2 * 10/2012 Rutz ..... A47B 3/0818 108/115
8,414,079 B1 * 4/2013 Zenoff ..... A47C 16/025 297/423.46
2016/0288280 A1 * 10/2016 Lin ..... B25J 5/007
2022/0211172 A1 * 7/2022 Kondel ..... A47B 13/081

OTHER PUBLICATIONS

Written Opinion for PCT/US2020/042957 dated Oct. 30, 2020 (5 pages).

* cited by examiner

MOBILE TABLE WITH SELECTIVELY ROTATING TABLE TOP

TECHNICAL FIELD

The present invention generally relates to the field of tables and table assemblies, and more particularly, to mobile tables having a selectively rotating table top relative to its frame.

BACKGROUND

Many classroom and shop settings require the use of sturdy industrial strength tables and/or work tops/work benches. However, these industrial strength tables and tops are often very large, heavy, cumbersome, and partially or completely immobile. Furthermore, the above mentioned conventional tables and work tops span a large footprint within the classroom and/or work space, thus requiring large spaces for their use. However, in many settings (e.g., when work space is limited and/or mobility and space versatility is desired), the above-mentioned characteristics are highly undesirable and are even sought to be avoided. Thus, alternative work tops and tables that directly address at least the above-mentioned problems are needed.

SUMMARY

Disclosed herein are industrial strength tables that address the problems observed with conventional tables and work tops/benches in classroom and shop/work space settings. In particular, these tables are easily (and selectively) mobile from one location to another and the table top is selectively rotatable between a plurality of locked positions to advantageously increase the overall foot print while the table is in use (e.g., deploying the table top for use in a first position) and/or reduce the overall foot print (e.g., orienting the table top in a vertical second position) thereby advantageously allowing for storage in small spaces when one has finished the use thereof. More particularly and in certain aspects, disclosed is a mobile table including a selectively rotatable table top that is configured to securely rotate about an axis in an unlocked position and to be secured in a predetermined plane in a locked position; and two spaced apart frame members securely connected to the selectively rotatable table top that is positioned on a first end of each spaced apart frame member and with movement members attached to a second end of each spaced apart frame members that are configured to selectively move the mobile table to and from desired locations.

In certain aspects of the mobile table, each frame member includes two spaced apart frame legs that are connected to one another on the first end of the frame member by a cross-beam and the cross-beam of each frame member is co-planar relative to one another within the table.

In certain aspects of the mobile table, the selectively rotatable table top is configured to selectively rotate and lock in a clockwise or counterclockwise direction relative to the frame members.

In certain aspects of the mobile table, the selectively rotatable table top is configured to selectively rotate to and lock in a first position that is substantially coplanar with the cross-beams of each frame member of the table and in a second position that is substantially perpendicular relative to the cross-beams of each frame member of the table.

In certain aspects of the mobile table, the selectively rotatable table top is configured to selectively rotate and lock in a plurality of predetermined positions in between the first and second positions.

In certain aspects of the mobile table, the mobile table further includes a stationary storage shelf affixed to the mobile table between the two spaced apart frame members and below the selectively rotatable table top, the stationary storage shelf being more proximate to the second end of each spaced apart frame member than the first end of each spaced apart frame member to provide sufficient clearance for the selectively rotatable table top such that the selectively rotatable table top can rotate 360° about the axis in an unlocked position relative to the two spaced apart frame members.

In certain aspects of the mobile table, the stationary storage shelf is in a parallel plane relative to the cross-beams of each frame member.

In certain aspects of the mobile table, the mobile table further includes two rotatable bushings, with each bushing positioned within the first end of the spaced apart frame member and extending internally within the table towards one another, the rotatable bushings are axially aligned with one another and have the selectively rotatable table top securely attached thereto with one rotatable bushing being operably connected to a handle such that when handle is moved/rotated the two rotatable bushings and selectively rotatable table top move in concert with the handle between desired unlocked and locked positions.

In certain aspects of the mobile table, the table further includes a locking mechanism configured to selectively lock and unlock the selectively rotatable table top in predetermined positions relative to the two spaced apart frame members.

In certain aspects of the mobile table, the rotatable bushing that is operably connected to the handle is coupled to a rotating disc having a plurality of through holes positioned thereon, the rotating disc configured to move in concert with the handle, two rotatable bushings, and selectively rotatable table top such that the locking mechanism selectively engages and disengages the through holes of the rotating disc to obtain the desired unlocked and locked positions of the selectively rotatable table top.

In additional aspects, also disclosed is a mobile table assembly including (a) a plurality of movement members that are configured to selectively move the mobile table to and from desired locations; (b) a selectively rotatable table top that is configured to rotate and lock in a plurality of different positions relative to two spaced apart frame members; and (c) two spaced apart frame members configured for secure connection to the selectively rotatable table top positioned there between on a first end of each spaced apart frame member and with at least one of the plurality of movement members attached to a second end of each spaced apart frame members.

In certain aspects of the table assembly, each frame member comprises two spaced apart frame legs that are connected to one another on the first end of the frame member by a cross-beam and the cross-beam of each frame member is co-planar relative to one another when assembled within the table.

In certain aspects of the table assembly, the selectively rotatable table top is configured to selectively rotate and lock in a clockwise or counterclockwise direction relative to the frame members.

In certain aspects of the table assembly, the selectively rotatable table top is configured to selectively rotate to and lock in a first position that is substantially coplanar with the cross-beams of each frame member of the table and in a second position that is substantially perpendicular relative to the cross-beams of each frame member of the table when assembled.

In certain aspects of the table assembly, the selectively rotatable table top is configured to selectively rotate and lock in a plurality of predetermined positions in between the first and second positions when assembled within the table.

In certain aspects of the table assembly, the assembly further includes a stationary storage shelf configured for attachment to the mobile table between the two spaced apart frame members and to be positioned below the selectively rotatable table top, the stationary storage shelf configured to be more proximate to the second end of each spaced apart frame member than the first end of each spaced apart frame member to provide sufficient clearance for the selectively rotatable table top such that the selectively rotatable table top can rotate 360° about the axis in an unlocked position relative to the two spaced apart frame members when assembled within the table.

In certain aspects of the table assembly, the stationary storage shelf is configured to be in a parallel plane relative to the cross-beams of each frame member.

In certain aspects of the table assembly, the assembly further includes two rotatable bushings, with each bushing positioned within the first end of the spaced apart frame member and extending internally within the table towards one another when the table is assembled, the rotatable bushings are configured to be axially aligned with one another and have the selectively rotatable table top securely attached thereto with one rotatable bushing configured to be operably connected to a handle such that when the table is assembled and the handle is moved/rotated the two rotatable bushings and selectively rotatable table top move in concert with the handle between desired unlocked and locked positions.

In certain aspects of the table assembly, the assembly further includes a locking mechanism configured to selectively lock and unlock the selectively rotatable table top in predetermined positions relative to the two spaced apart frame members.

In certain aspects of the table assembly, the rotatable bushing that is configured to be operably connected to the handle is coupled to a rotating disc having a plurality of through holes positioned thereon, the rotating disc is configured to move in concert with the handle, two rotatable bushings, and selectively rotatable table top when the table is assembled such that the locking mechanism is configured to selectively engage and disengage the through holes of the rotating disc to obtain the desired unlocked and locked positions of the selectively rotatable table top.

Embodiments of the invention can include one or more or any combination of the above features and configurations.

Additional features, aspects and advantages of the invention will be set forth in the detailed description, which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

FIGS. 1-11 depict the table/table assembly 100 disclosed herein. In certain aspects, various components of the table/table assembly 100 are comprised of aluminum or steel components such that the table assembly is durable and has industrial strength. It should be further noted that these table assemblies include swivel casters 2 (movement members) allowing for selectively mobility of the assembly around, for example, a shop or a classroom. In certain aspects, these swivel casters 2 are further equipped with brakes to further selectively control movement of the assembly and to further achieve/maintain stationary positioning as desired by the assembly user.

Figure 8:
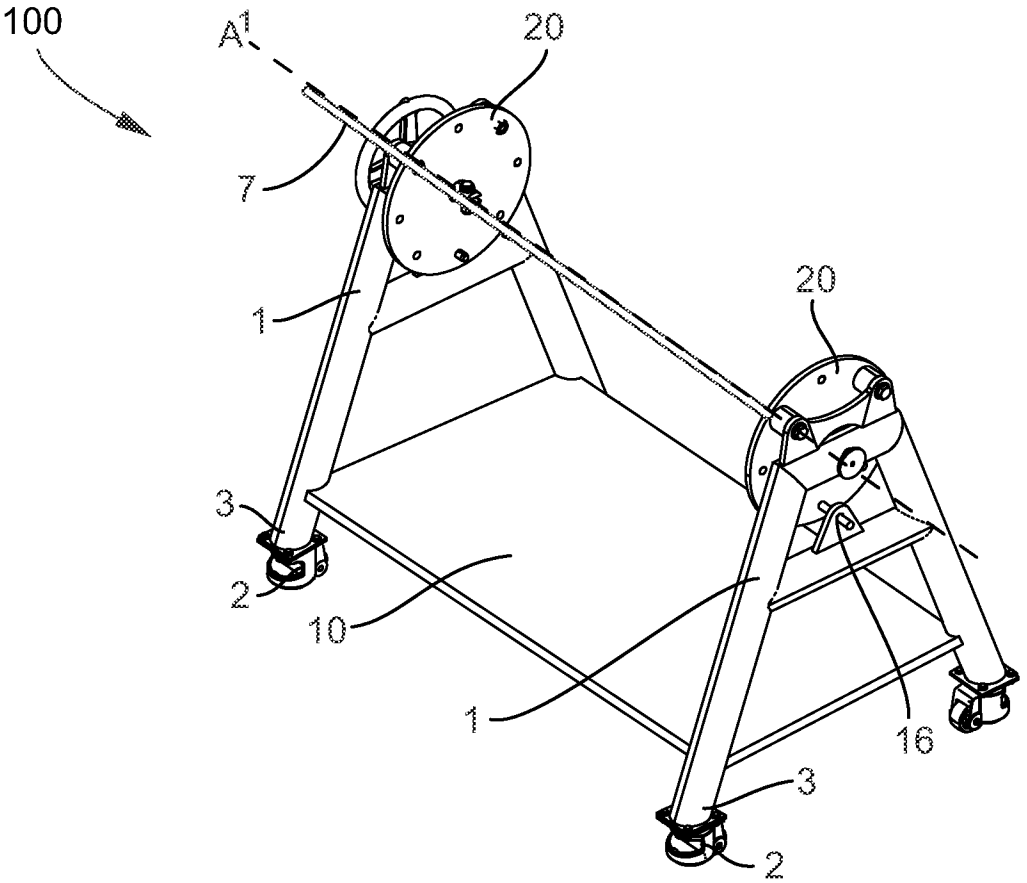
FIG. 8 depicts a perspective view of the assembled table with the selectively rotatable table top selectively rotated and locked into an intermediate position (i.e. a position between the first and second positions)
Figure 9:
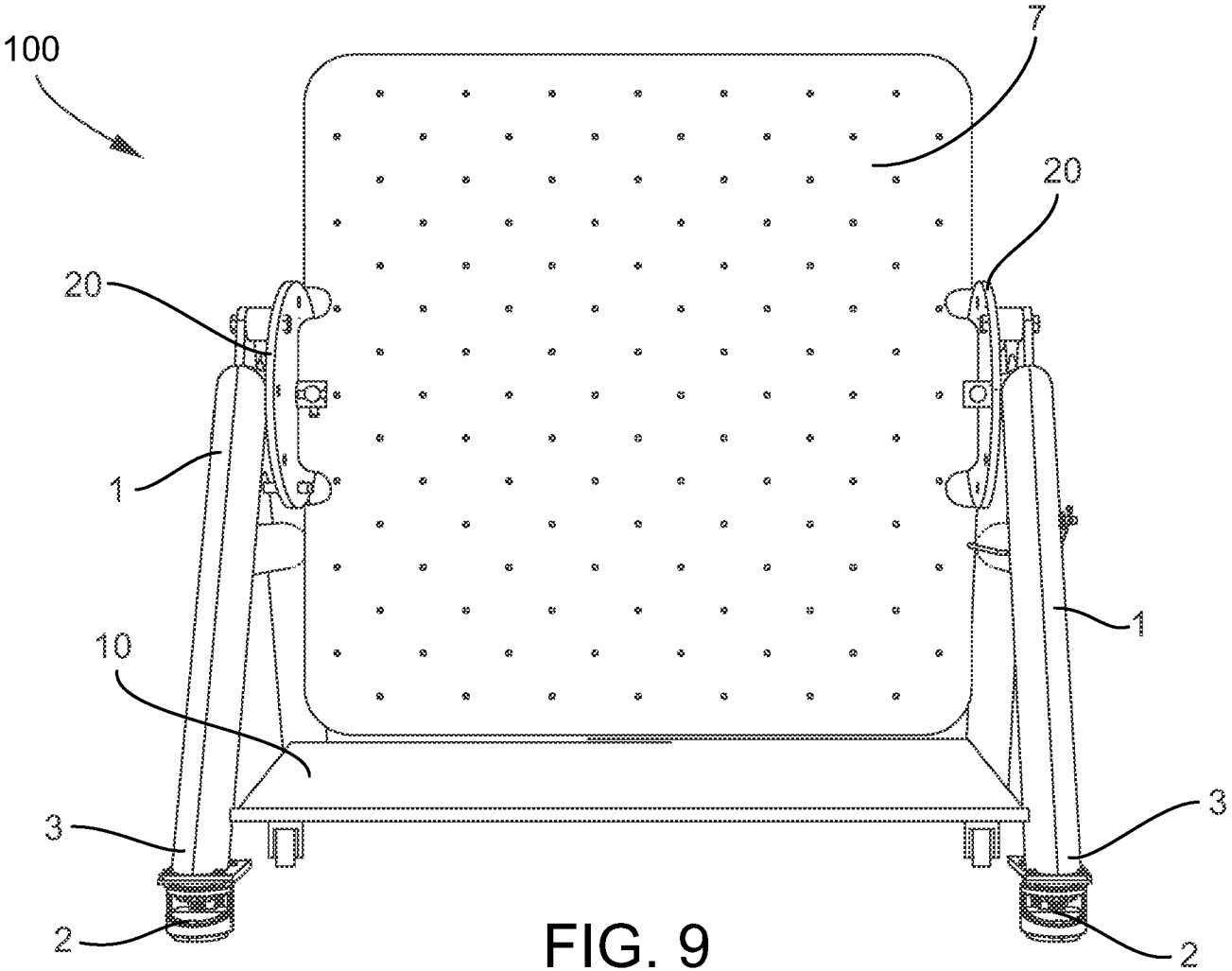
FIG. 9 depicts a perspective view of the assembled table with table top selectively rotated and locked into a vertical position (second position)
Figure 10:
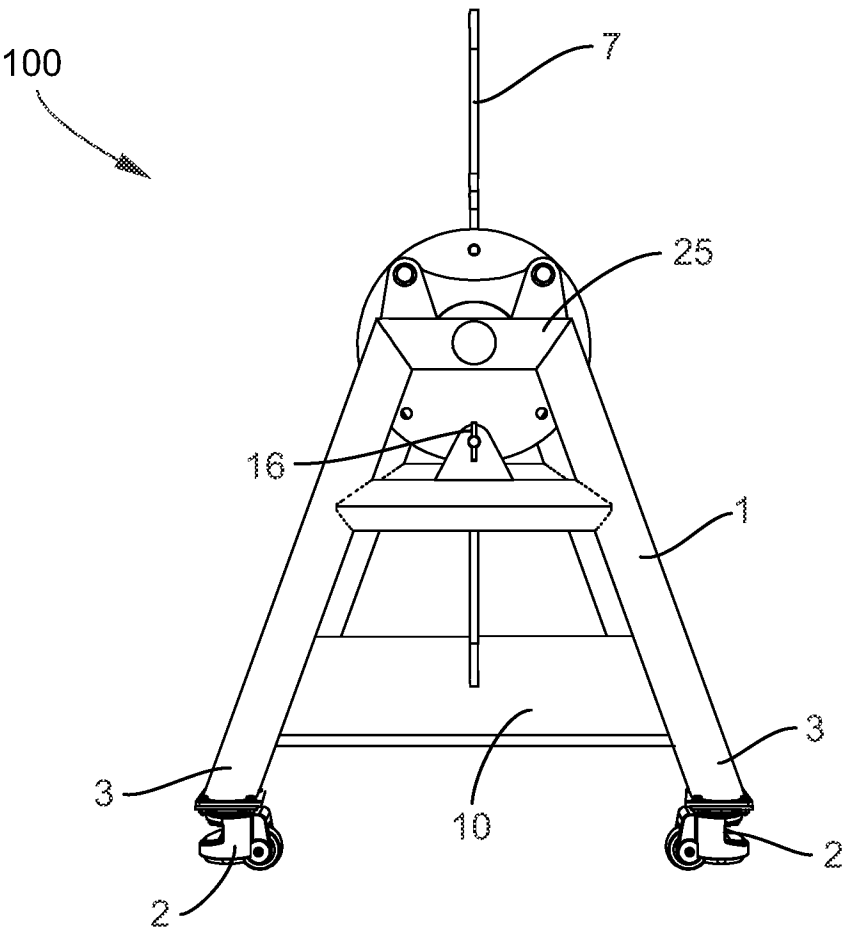
FIG. 10 depicts a side view of the assembled table with the table top selectively rotated and locked into a vertical position (second position)
Figure 11:
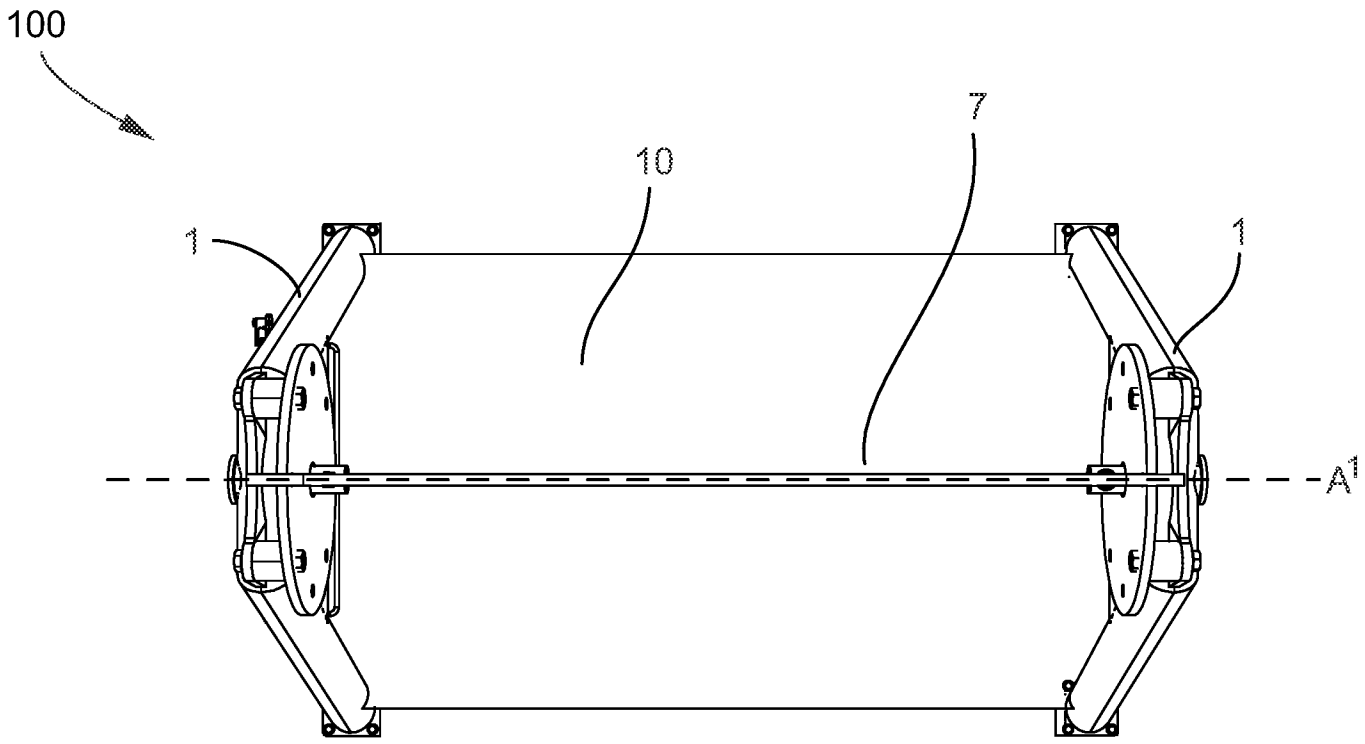
FIG. 11 depicts a top view of the assembled table with table top selectively rotated and locked into a vertical position (second position).

As further shown in FIGS. 1-11, when the table assembly 100 is assembled, the table assembly is configured such that the table top 7 is selectively rotatable relative to the frame 1 such that a plurality of fixed positions may be achieved. For example, FIGS. 1, 3, 6, and 7 depict the assembled table with the table top secured in a horizontal position (first position) (e.g., table top is in a parallel plane relative to shelf 10). FIG. 8 depicts a perspective view of the assembled table with table top selectively rotated into an intermediate position (i.e., a position between the first and second positions), and FIGS. 9-11 the assembled table with table top selectively rotated into a vertical position (second position) (e.g., table top is substantially perpendicular relative to shelf 10). The ability to selectively rotate the table top 7 at different angles allows a user to reduce the overall foot print of the assembly, advantageously allowing for storage in small spaces.

In certain aspects, the table top 7 can rotate and lock at +/−+/−90°, and +/−180° and/or at other desired, predetermined increments within the 360' rotational axis Utile table top (e.g., +/−15° increments, etc.), To achieve the above mentioned rotation and table top positions, the table assembly 100 is equipped with an easy-to-turn spoke wheel (handle) 13, bushings 4, alignment bolts, spacers 6, pads, and two locking wheels 20 with a plurality of through holes 21 arranged thereon to ensure a solid and predictable angle.

Figure 1:
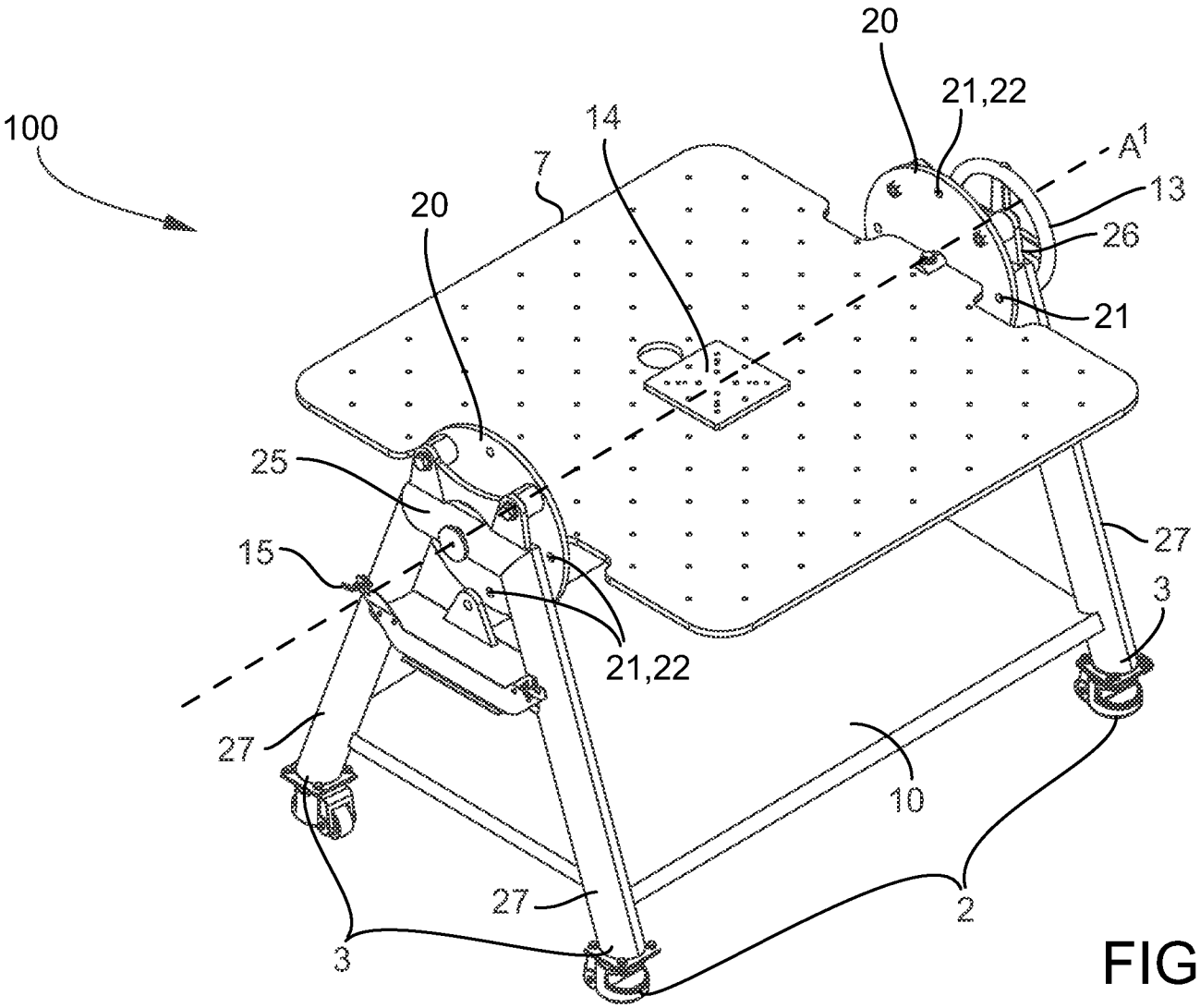
FIG. 1 depicts the assembled table with the selectively rotatable table top secured in a horizontal position (first position)
Figure 2B:
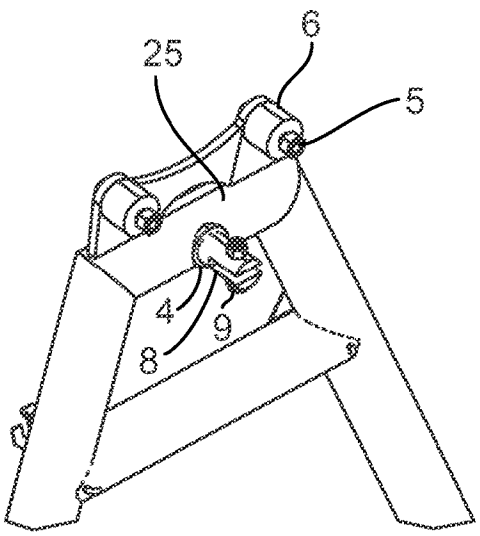
FIG. 2B depicts a magnified view of Detail A of FIG. 2A.
Figure 2A:
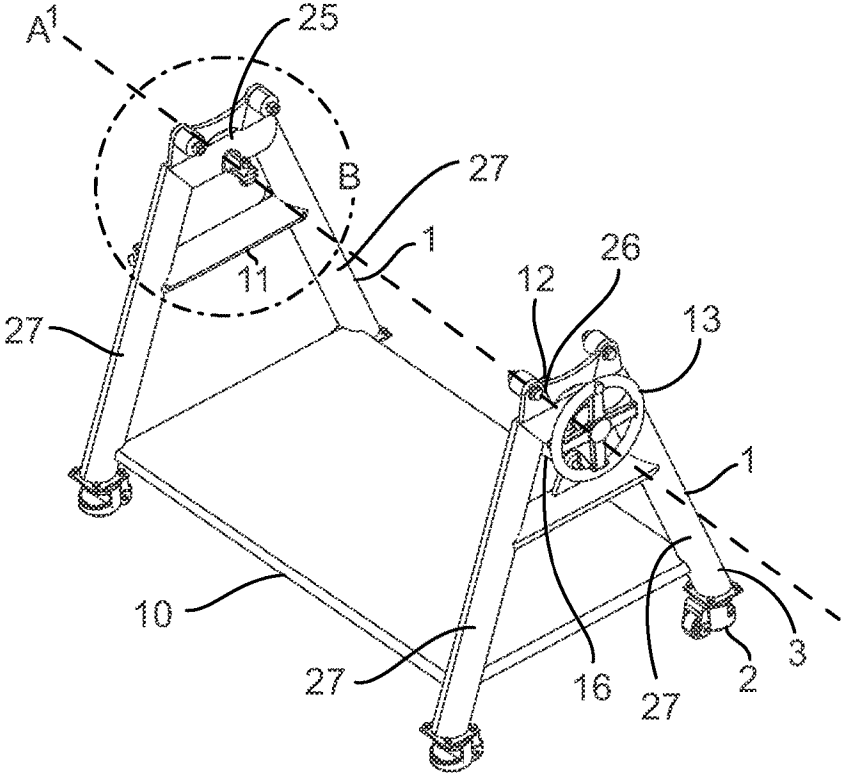
FIG. 2A depicts a partially disassembled table assembly.
Figure 3:
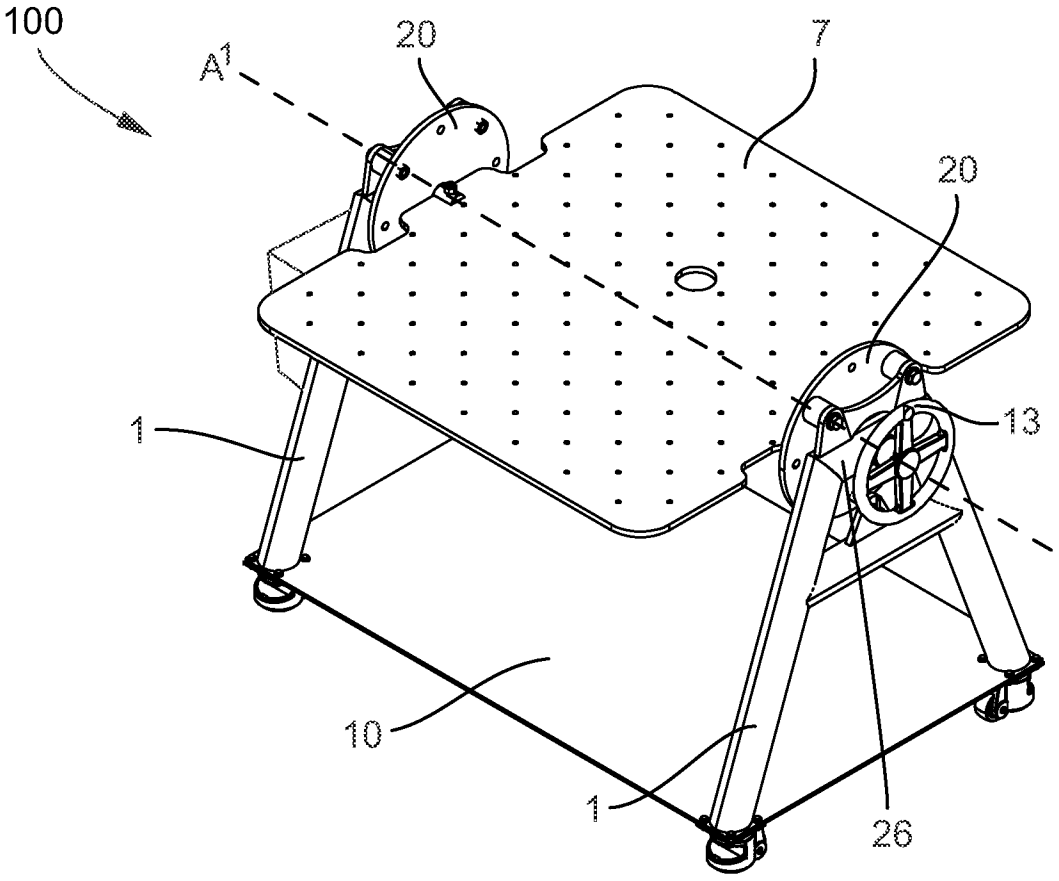
FIG. 3 depicts a perspective view of the assembled table with the selectively rotatable table top secured in a horizontal position (e.g., a first position)
Figure 4:
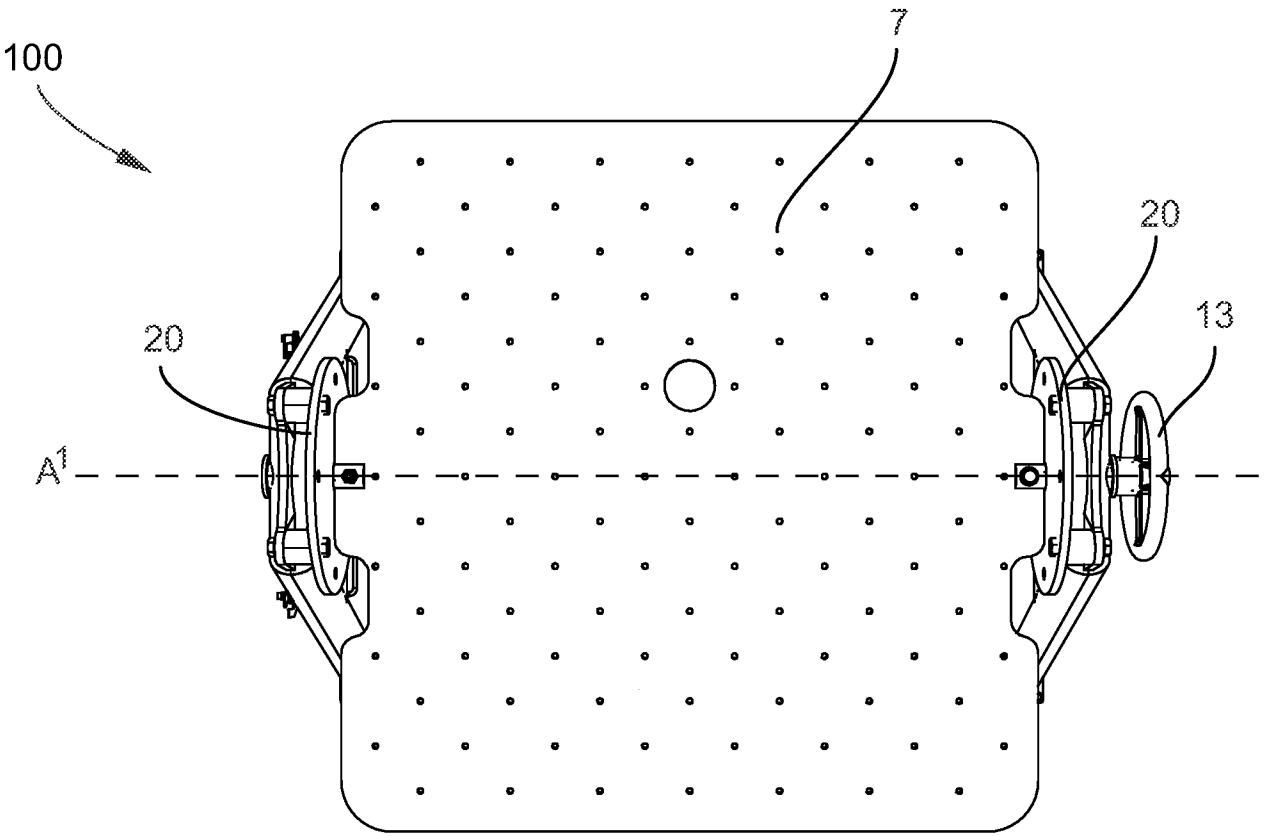
FIG. 4 depicts a top view of the assembled table with the selectively rotatable table top secured in a horizontal position.
Figure 5:
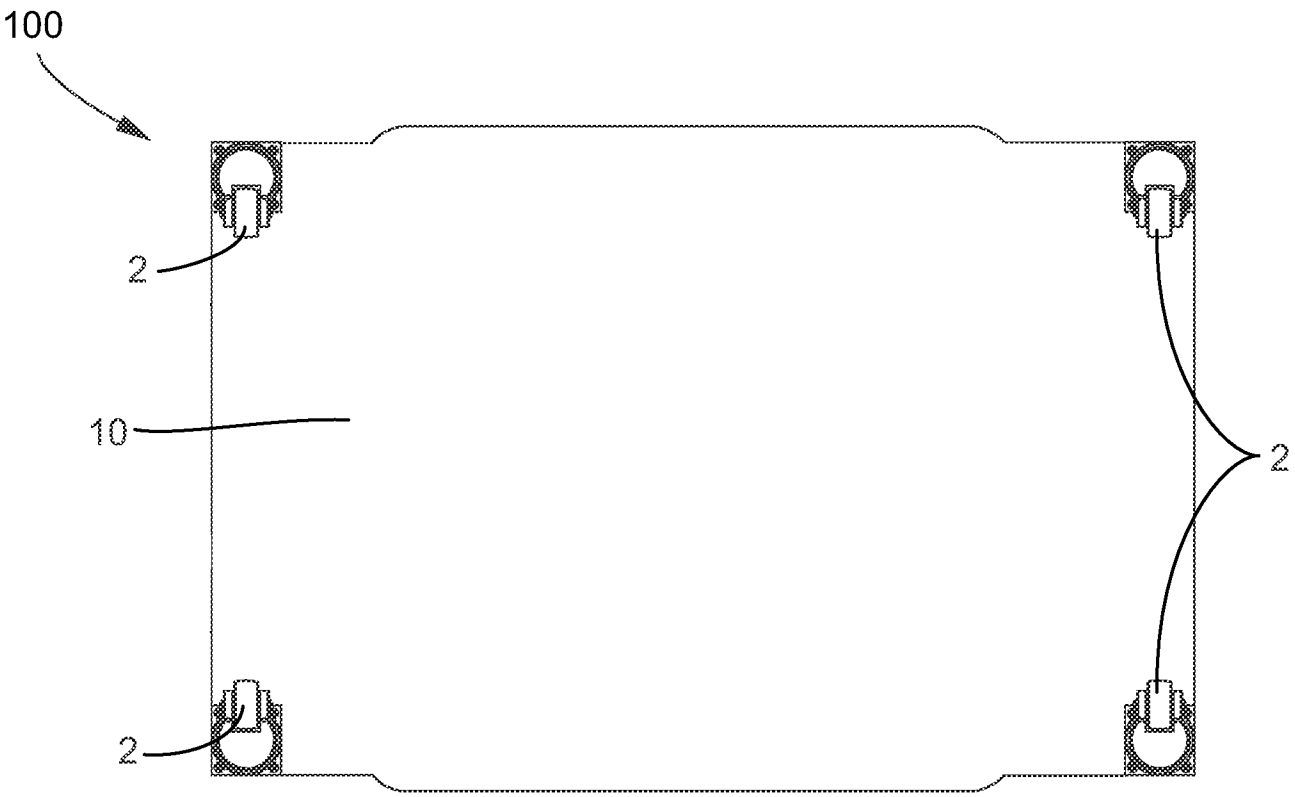
FIG. 5 depicts a bottom view of the assembled table.
Figure 6:
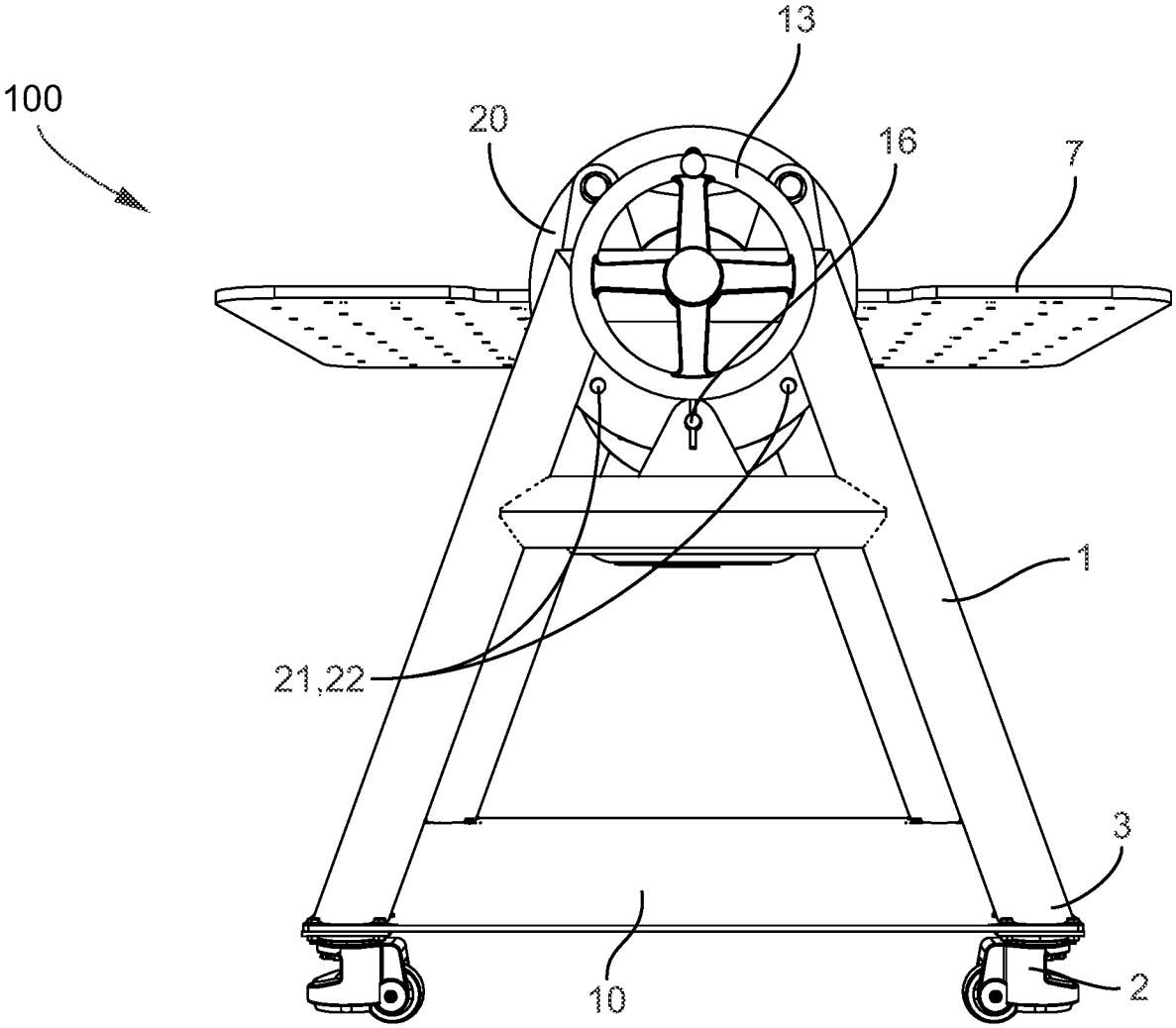
FIG. 6 depicts a right side view of the assembled table with the table top secured in a horizontal position.
Figure 7:
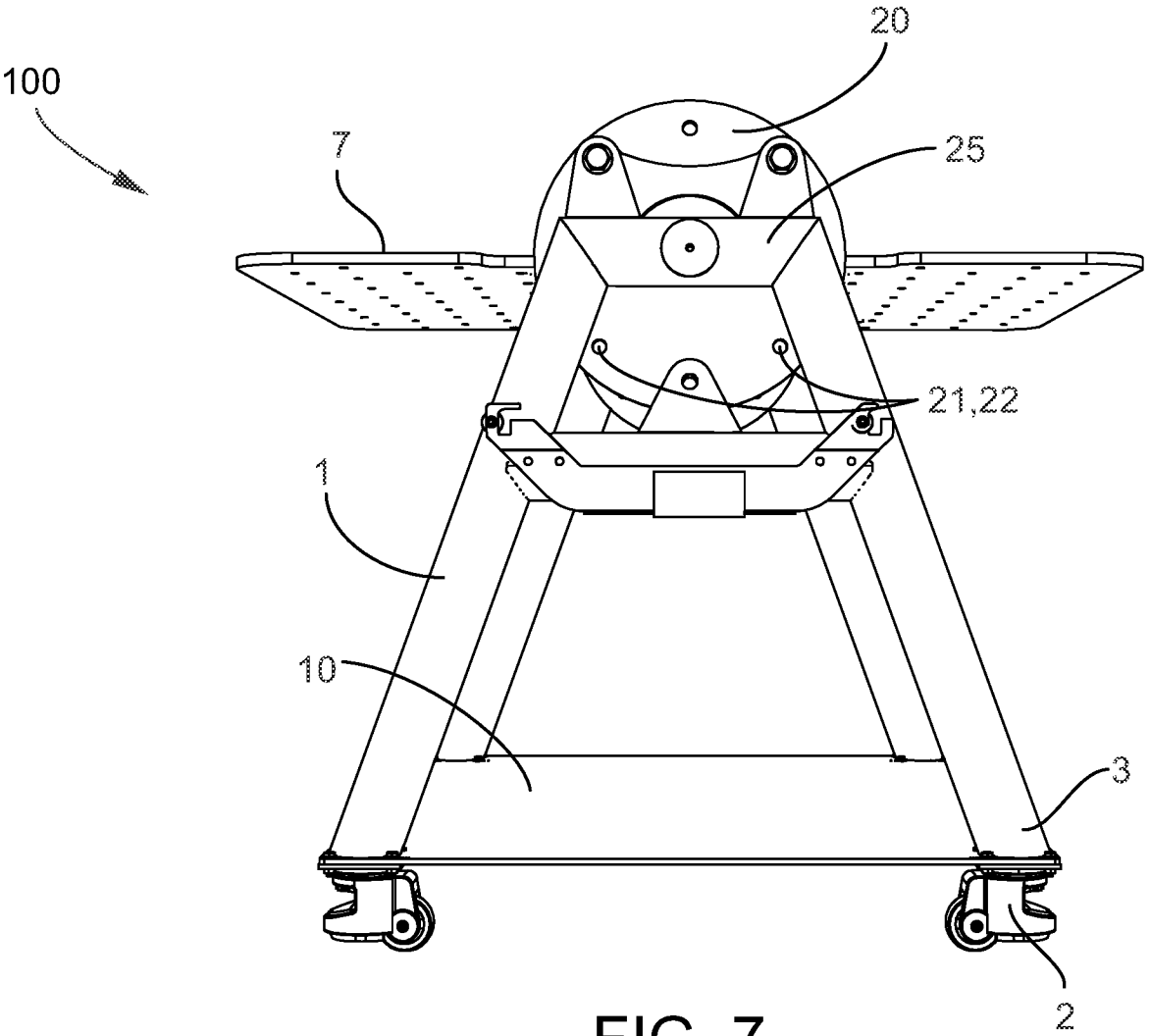
FIG. 7 depicts a left side view of the assembled table with the selectively rotatable table top secured in a horizontal position (e.g., a first position)

With specific reference to FIGS. 1, 2A, and 2B, two rotatable bushings 4 are positioned on opposite sides of the frame 1 and are axially aligned with one another. At least one bushing 4 is operably connected to handle 13 such that when handle 13 is moved/rotated the operably connected bushing moves in concert with the handle. As further shown in FIG. 2B, recesses are formed within each bushing such that the table top 7 is received there through and is affixed therein with, for example, a fastener, locking pin, and/or friction fit. As further shown in FIG. 1 in view of FIGS. 2A and 2B, locking wheels 20 are arranged on the frame and are connected to bushings 4. Each locking wheel 20 includes a plurality of through holes 21, and when assembled, the through holes of each locking wheel are axially aligned with a corresponding through hole of a corresponding locking wheel. The through holes 21 of each locking wheel 20 are arranged to align with spacers 6 and to be temporarily affixed to the frame by lock wheel hardware 5 that temporarily locks the locking wheels 20 into a desired position. A spring biased quick release locking pin 16 is also arranged on the frame 1. The spring biased quick release locking pin 16 further engages a through hole 21 of at least one locking wheel 20 to maintain table top position regardless of whether the locking wheels are (or are not) temporarily affixed to the frame by lock wheel hardware 5.

When moving the table top 7 from a first position (e.g., horizontal position) to another desired position, the lock wheel hardware 5 is initially removed and the spring biased quick release locking pin 16 is subsequently disengaged such that the locking wheels 20, bushings 4, and table top 7 are rotatable relative to the frame 1. Next, the table top 7 is rotated to the desired position by rotating handle 13, which further rotates each bushing 4, locking wheel 20, and table top 7 in concert. The desired through hole 21, 22 of at least one locking wheel 20 is aligned with the spring biased quick release locking pin 16 and the spring biased quick release locking pin 16 subsequently engages the desired locking wheel through hole. Next, the locking through holes 21 that are aligned with the spacers 6 are subsequently affixed thereto by locking wheel hardware 5, thus locking table top 7 into a desired position.

As further shown in FIGS. 1-11, the table assembly 100 further includes shelf 10 that is connected to the bottom of frame 1. In certain aspects, shelf 10 is detachable along with the table top 7 for ease of shipping and assembly. For those that require shipping, the table legs can be easily unbolted and two bolts connecting the table can be removed and now the table can be stacked on a pallet.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

PARTS LIST

100 Table/Table Assembly
1 Frame (Frame members)
2 Swivel Casters (Movement members)
3 End of Frame Legs (Second End(s) of Each Frame Member)
4 Rotatable Bushing Configured Securely Receive Table top
5 Lock Wheel Hardware (for fixing Lock wheel to frame)
6 Spacer
7 Table top
8 Rotating Lock Pin
9 Table Hardware (for fixing Table top rotatable bushing and rotating lock pin)
10 Shelf (Storage Shelf Affixed to/Between Legs of Frame Member(s))
11, 15, 25, 26 Bracket (Cross-Beam)
12 Rotating Lock Pin Wheel (Rotating Disc)
13 Handle (operably connected to lock pin wheel and bushing to selectively rotate table top)
14 Plate
16 Quick Release Locking Pin
20 Locking Wheels
21, 22 Holes (Plurality of Through Holes On Rotating Disc)
$A^1$ Axis of Rotation (for Table Top) And Axial Alignment of Bushings
27 Individual Frame Legs

What is claimed is:

1. A mobile table comprising:

a selectively rotatable table top that is configured to securely rotate about an axis in an unlocked position and to be secured in a predetermined plane in a locked position; and two spaced apart frame members securely connected to the selectively rotatable table top positioned on a first end of each spaced apart frame member, the two spaced apart frame members comprising locking wheels with a plurality of through holes arranged thereon for aligning the selectively rotatable table top at one or more predictable angles, and movement members attached to a second end of each spaced apart frame members that are configured to selectively move the mobile table to and from desired locations.

2. The mobile table of claim 1, wherein each frame member comprises two spaced apart frame legs that are connected to one another on the first end of the frame member by a cross-beam and the cross-beam of each frame member is co-planar relative to one another within the table.

3. The mobile table of claim 2, wherein the selectively rotatable table top is configured to selectively rotate and lock in a clockwise or counterclockwise direction relative to the frame members.

4. The mobile table of claim 3, wherein the selectively rotatable table top is configured to selectively rotate to and lock in a first position that is substantially parallel with the cross-beams of each frame member of the table and in a second position that is substantially perpendicular relative to the cross-beams of each frame member of the table.

5. The mobile table of claim 4, wherein the selectively rotatable table top is configured to selectively rotate and lock in a plurality of predetermined positions in between the first and second positions.

6. The mobile table of claim 5, further comprising a stationary storage shelf affixed to the mobile table between the two spaced apart frame members and below the selectively rotatable table top, the stationary storage shelf being more proximate to the second end of each spaced apart frame member than the first end of each spaced apart frame member to provide sufficient clearance for the selectively rotatable table top such that the selectively rotatable table top is configured to rotate 360° about the axis in an unlocked position relative to the two spaced apart frame members.

7. The mobile table of claim 6, wherein the stationary storage shelf is in a parallel plane relative to the cross-beams of each frame member.

8. The mobile table of claim 7, further comprising two rotatable bushings, with each bushing positioned within the first end of the spaced apart frame member and extending internally within the table towards one another, the rotatable bushings are axially aligned with one another and have the selectively rotatable table top securely attached thereto with one rotatable bushing being operably connected to a handle such that when handle is moved/rotated the two rotatable bushings and selectively rotatable table top move in concert with the handle between desired unlocked and locked positions.

9. The mobile table of claim 8, wherein the locking wheels comprise a locking mechanism via the plurality of holes configured to selectively lock and unlock the selectively rotatable table top in predetermined positions at the one or more predictable angles relative to the two spaced apart frame members.

10. The mobile table of claim 9, wherein the rotatable bushing that is operably connected to the handle is coupled to a rotating disc of the locking wheels, the rotating disc configured to move in concert with the handle, two rotatable bushings, and selectively rotatable table top such that the locking mechanism selectively engages and disengages the through holes of the locking wheels to obtain the desired unlocked and locked positions of the selectively rotatable table top.

11. A mobile table assembly comprising:

(a) a plurality of movement members that are configured to selectively move the mobile table assembly to and from desired locations;

(b) a selectively rotatable table top that is configured to rotate and lock in a plurality of different positions relative to two spaced apart frame members, the two spaced apart frame members comprising locking wheels with a plurality of through holes arranged thereon for aligning the selectively rotatable table top at one or more predictable angles; and (c) the two spaced apart frame members, which are configured for secure connection to the selectively rotatable table top positioned there between on a first end of each spaced apart frame member and with at least one of the plurality of movement members attached to a second end of each spaced apart frame members.

12. The mobile table assembly of claim 11, wherein each frame member comprises two spaced apart frame legs that are connected to one another on the first end of the frame member by a cross-beam and the cross-beam of each frame member is co-planar relative to one another when assembled within the table.

13. The mobile table assembly of claim 12, wherein the selectively rotatable table top is configured to selectively rotate and lock in a clockwise or counterclockwise direction relative to the frame members.

14. The mobile table assembly of claim 13, wherein the selectively rotatable table top is configured to selectively rotate to and lock in a first position that is substantially parallel with the cross-beams of each frame member of the table and in a second position that is substantially perpendicular relative to the cross-beams of each frame member of the table when assembled.

15. The mobile table assembly of claim 14, wherein the selectively rotatable table top is configured to selectively rotate and lock in a plurality of predetermined positions in between the first and second positions when assembled within the table.

16. The mobile table assembly of claim 15, further comprising a stationary storage shelf configured for attachment to the mobile table between the two spaced apart frame members and to be positioned below the selectively rotatable table top, the stationary storage shelf configured to be more proximate to the second end of each spaced apart frame member than the first end of each spaced apart frame member to provide sufficient clearance for the selectively rotatable table top such that the selectively rotatable table top is configured to rotate 360° about the axis in an unlocked position relative to the two spaced apart frame members when assembled within the table.

17. The mobile table assembly of claim 16, wherein the stationary storage shelf is configured to be in a parallel plane relative to the cross-beams of each frame member.

18. The mobile table assembly of claim 17, further comprising two rotatable bushings, with each bushing positioned within the first end of the spaced apart frame member and extending internally within the table towards one another when the table is assembled, the rotatable bushings are configured to be axially aligned with one another and have the selectively rotatable table top securely attached thereto with one rotatable bushing configured to be operably connected to a handle such that when the table is assembled and the handle is moved/rotated the two rotatable bushings and selectively rotatable table top move in concert with the handle between desired unlocked and locked positions.

19. The mobile table assembly of claim 18, wherein the locking while comprise a locking mechanism via the plurality of holes configured to selectively lock and unlock the selectively rotatable table top in predetermined positions at the one or more predictable angles relative to the two spaced apart frame members.

20. The mobile table assembly of claim 19, wherein the rotatable bushing that is configured to be operably connected to the handle is coupled to a rotating disc of the locking wheels, the rotating disc is configured to move in concert with the handle, two rotatable bushings, and selectively rotatable table top when the table is assembled such that the locking mechanism is configured to selectively engage and disengage the through holes of the locking wheels to obtain the desired unlocked and locked positions of the selectively rotatable table top.

* * * * *